US005420564A

United States Patent [19]

Remington

[11] Patent Number: 5,420,564

[45] Date of Patent: May 30, 1995

[54] DOOR CHIME ASSEMBLY

[75] Inventor: Duncan Remington, Naples, N.Y.

[73] Assignee: Fred M. Schildwachter & Sons, Inc., Bronx, N.Y.

[21] Appl. No.: 91,330

[22] Filed: Jul. 14, 1993

[51] Int. Cl.[6] ..... G08B 3/00; G10K 1/00

[52] U.S. Cl. ..... 340/392.1; 340/392.4; 340/392.5; 340/396.1; 84/403; 84/410; 116/141

[58] Field of Search ..... 340/392.1, 392.4, 392.5, 340/396.1, 398.2; 84/402–406, 410; 116/141

[56] References Cited

U.S. PATENT DOCUMENTS 2,245,453 6/1941 Warren ..... 340/392.4
2,265,815 12/1941 Rittenhouse ..... 340/392.5
2,486,680 11/1949 Reck ..... 340/392.4
3,246,321 4/1966 Doggart ..... 340/392.5

*Primary Examiner*—Donnie L. Crosland
*Attorney, Agent, or Firm*—Brooks Haidt Haffner & Delahunty

[57] ABSTRACT

Door chime assembly includes a chime base having a rear plate and at least one resonance chamber secured to said rear plate, a tone bar within the chamber and a striking means mounted on the plate for striking the tone bar. The chime base is molded in a single piece and employs at least one living hinge which permits folding of parts of the assembly to form the resonance chamber. The tone bar is mounted on dowels in the chamber of a length which prevents the tone bar from falling off the dowels during transit.

26 Claims, 3 Drawing Sheets

DOOR CHIME ASSEMBLY

BACKGROUND OF THE INVENTION

1. Field of the Invention

This invention relates to a door chime assembly, and more particularly to a one-piece door chime assembly having one or more resonance chambers with portions which are foldable to provide such chambers.

2. Background and Objects of the Invention

Door chimes are well known in the art and typically include a chime base holding one or more tone bars and a striking means to strike the tone bars, which vibrate with a predetermined tone. Conventional chime bases also include one or more sound or resonance chambers which amplify the tone bar vibration. Conventional door chime bases, particularly the sound or resonance chambers, are typically made of several component parts, which require handling and assembly. Even for chime bases made by injection molding, a separate piece is necessary to enclose each sound chamber. These extra pieces add to the amount of handling required to assemble each door chime.

In addition to the problem of increased handling, a further problem of conventional door chimes is that the tone bars become misaligned or loose when shipped or mishandled. Conventional solutions to this problem have included tightening the tone bars with rubber bands as well as using cardboard inserts to wedge the bars in place during transit which bands or inserts must be removed before the chime assembly is placed in operation. Although ostensibly solving the problem, these solutions further increase the amount of handling required and require actions on the part of the purchaser to remove the retaining devices.

One object of the invention is to reduce the number of component parts required to assemble a door chime, particularly by reducing the number of component parts in the door chime base.

Another object of the invention is to reduce the amount of handling required by molding the entire chime base from a single piece of material, the parts of which may be easily folded to provide the resonance chambers.

A further object of the invention is to facilitate the shipping of door chimes, particularly the securing of the tone bars, by eliminating the special packaging requirements necessary to secure conventional tone bars in place during transit.

SUMMARY OF THE INVENTION

In accordance with the preferred embodiment of the invention, a door chime assembly includes a door chime base having one or more sound or resonance chambers, each of which encloses a tone bar, and wherein the entire chime base is made of a single piece of plastic material, and includes one or more living hinges to connect the component base parts and to form the sound chamber structures.

BRIEF DESCRIPTION OF THE DRAWINGS

Other objects and advantages of the present invention will be apparent from the following detailed description of the presently preferred embodiments thereof, which description should be considered in conjunction with the accompanying drawings in which.

DETAILED DESCRIPTION OF THE PREFERRED EMBODIMENT

Figure 1:
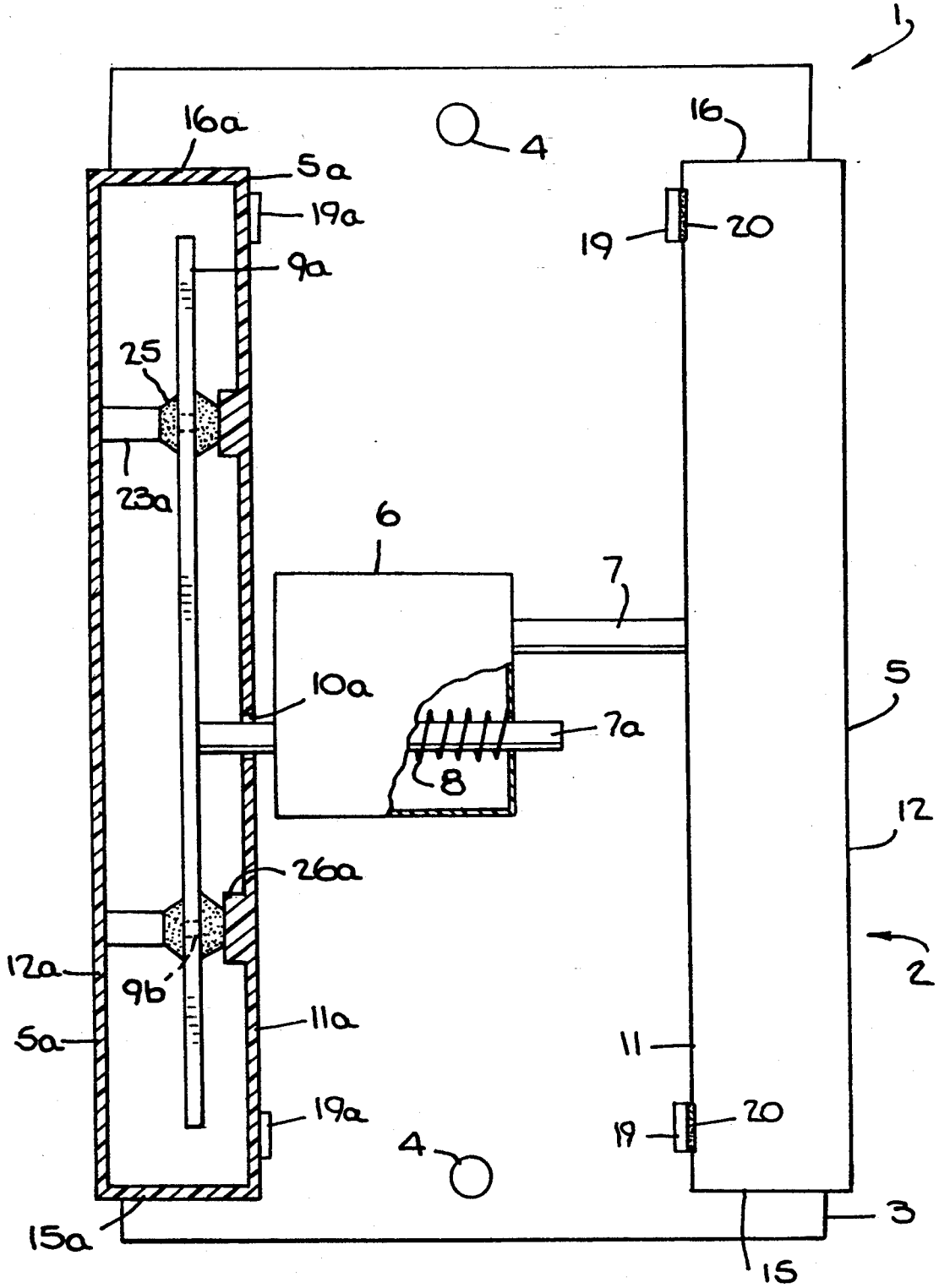
FIG. 1 is a top view, partly in section, of an assembled door chime base, tone bars and striking means of the claimed invention.
Figure 2:
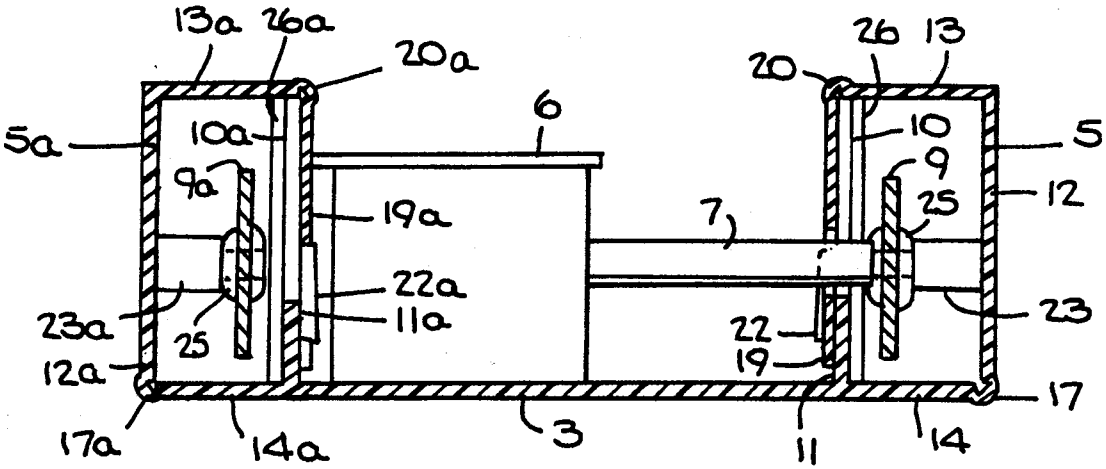
FIG. 2 is an end elevation view, partly in section, of the assembled door chime shown in FIG. 1.

With reference to FIGS. 1–4, the preferred embodiment of the door chime assembly 1 of the invention includes a base portion 2 which is illustrated in FIGS. 1 and 2 in an assembled state without a decorative cover. Door chime base portion 2 includes a rear plate 3 having mounting holes 4 to secure said base 2, and hence, said assembly 1, to a wall. Base portion 2 also includes a pair of resonance chambers 5 and **5*a*, forming an integral part with said rear plate 3. A conventional solenoid, or strike means 6 is secured to said rear plate 3 adjacent said resonance chambers 5 and 5*a*. In the embodiment shown in FIGS. 1–4, a pair of opposed resonance chambers 5 and 5*a* are shown with said solenoid means 6** secured between them.

Although not required in accordance with principles of the invention, it is conventional to provide the door chime assembly 1 with two chime bars 9 and **9*a*, two of which are struck by a first electromagnetically movable rod when a first door button, e.g. a front door button, is operated and one of which is struck by a second electromagnetically movable rod when a second door button, e.g., a back door button is operated. Each strike rod is movable by separate, electrically energizable solenoids. Solenoid means 6 includes one or more strike rods 7 and 7*a*, each situated within an electrically energizable solenoid 8 (only one of which is schematically shown in FIG. 1), which when energized causes said strike rod 7 or 7*a* to move longitudinally of its axis and strike a tone bar 9 or 9*a*, as shown in FIGS. 1 and 2, causing the respective tone bar 9 or 9*a* to vibrate at a predetermined tone. Conventional chimes typically place said resonance chambers 5 and 5*a* around or in close proximity to the tone bars 9 and 9*a* to amplify the sound. Strike rods 7 and 7*a* pass through one or more openings or slots 10 and 10*a* along inner walls 11 and 11*a* of said resonance chambers 5 and 5*a*, where said inner walls 11 and 11*a* face said solenoid means 6. When struck by said strike rod 7 or 7*a*, tone bar 9 or 9*a* vibrates within said resonance chamber 5** at said predetermined tone.

Figure 4:
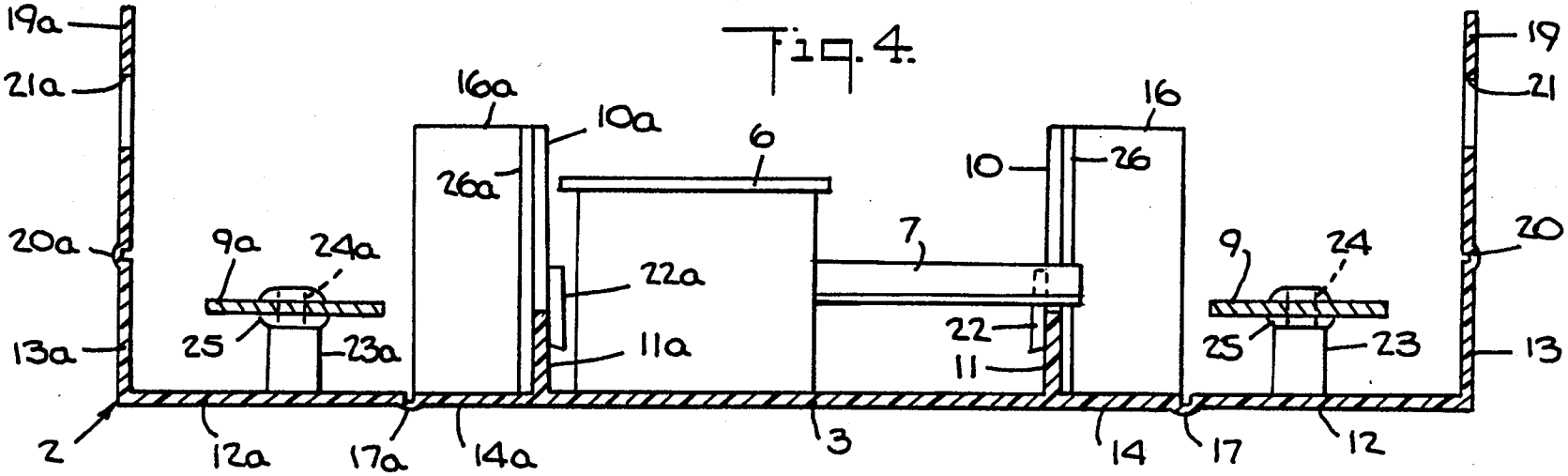
FIG. 4 is an end elevation view, partly in section, of the unassembled door chime base embodiment shown in FIG. 3.
Figure 3:
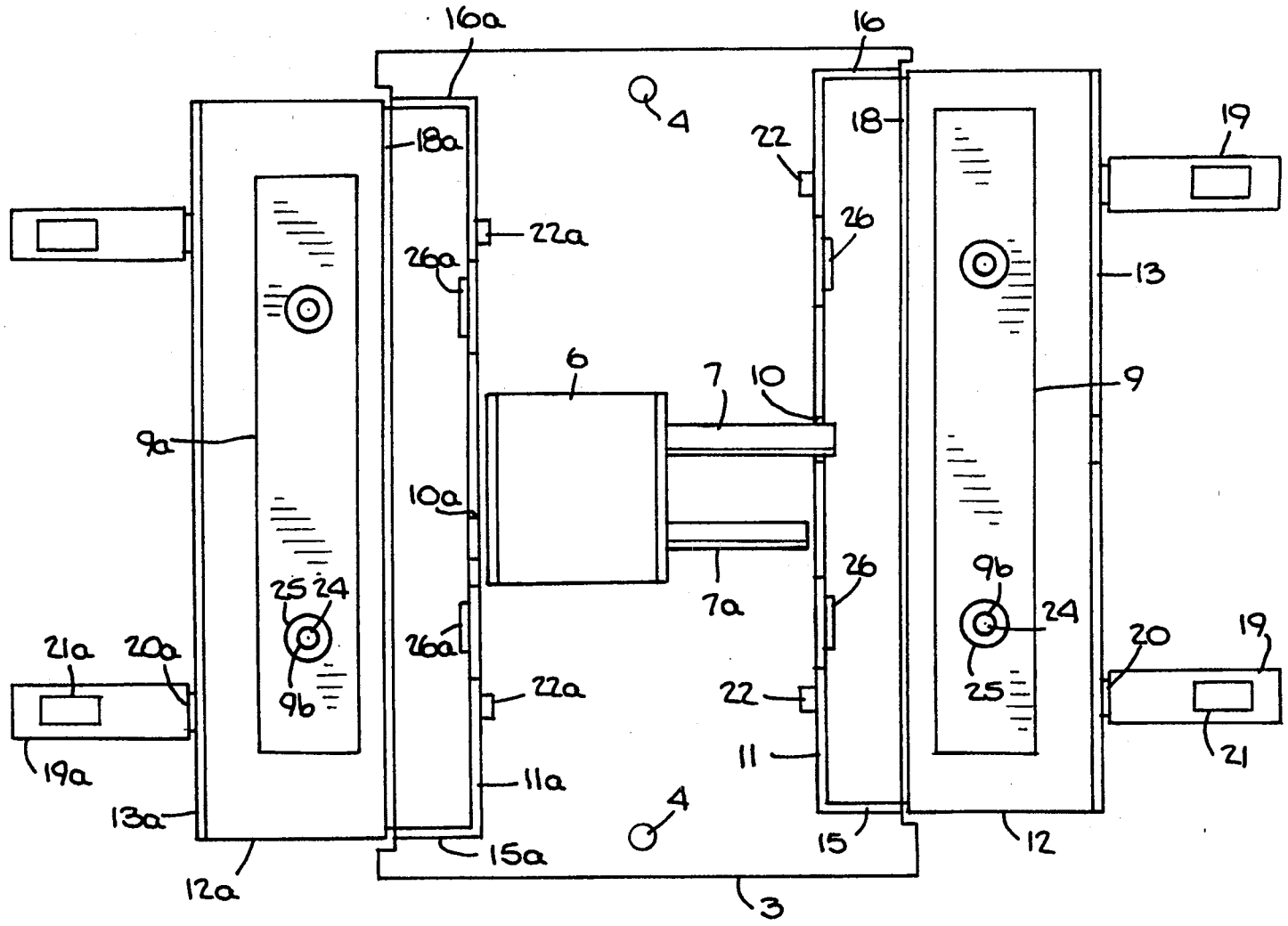
FIG. 3 is a top view of the door chime embodiment of FIGS. 1 and 2 unassembled.

As shown in FIGS. 1 and 2, each resonance chamber 5 and **5*a*, in addition to inner walls 11 and 11*a*, includes outer walls 12 and 12*a*, top wall 13 and 13*a*, a bottom wall 14 and 14*a* (portions of the plate 3), a front wall 15 and 15*a* and a back wall 16 and 16*a*, where the front walls and back walls being integral with the respective walls 11 and 11*a*. As shown in FIGS. 3 and 4, instead of the resonance chambers 5 and 5*a* being made of several separate components as in conventional chimes, each requiring handling and assembly, each of the walls is, preferably, attached to one another, forming a simple-to-assemble one-piece door chime base portion 2**.

Outer walls 12 and **12*a* and top walls 13 and 13*a* are connected to said bottom walls 14 and 14*a*, i.e. the rear plate 3, by line or living hinges 17 and 17*a*, which form a flexible bridge of material between said outer walls 12** and 12*a* and rear plate 3 (bottom walls 14 and 14*a* ), pivotably joining said outer walls 12 and 12*a* to rear plate 3 along the junctures 18 and 18*a* between them, as shown in FIG. 3. Living hinges 17 and 17*a* are preferably made of the same material as said door chime base portion 2, but are sufficiently thinned so that the living hinges 17 and 17*a* bend, allowing the outer walls 12, 12*a*, and 13, 13*a* to fold over and contact inner walls 11 and 11*a*, respectively. Although other plastics can be used, suitable materials for both base 2 and living hinges 17 and 17*a* include polypropylene and compositions of polypropylene including up to 20% of talc. By sealing the junctures 18 and 18*a* with living hinges 17 and 17*a*, resonating air within said resonance chambers 5 and 5*a* is restricted along the junctures, thereby preserving the tonal resonance with the chambers 5 and 5*a*. Since conventional resonance chambers are made of several separate pieces each requiring individual handling, one advantage of using living hinges is that the entire door chime base portion 2 may be uniformly made by straight injection molding into a single piece, as shown in FIGS. 3 and 4, which may be then easily assembled, as shown in FIGS. 1 and 2, thereby greatly reducing the handling process. It should nonetheless be understood that line or living hinges 17 and 17*a* can attach the above walls across junctures 18 and 18*a* with a plurality of short hinge sections along the junctures.

Attached to said top walls 13 and 13*a* are a pair of clasp means comprising straps 19 and 19*a*, which are preferably secured to said top walls 13 and 13*a*, respectively, by living hinges 20 and 20*a*, which allow the straps 19 and 19*a* to also be injection molded as a component part of the one-piece chime base portion 2 described above. The straps 19 and 19*a*, shown bent back in FIG. 3, include slotted portions 21 and 21*a*, respectively, which upon closing of the resonance chambers 5 and 5*a*, as shown in FIGS. 1 and 2, engage one of a pair of corresponding projections 22 and 22*a* secured along the exterior of the inner side walls 11 and 11*a* of the resonance chambers 5 and 5*a*. When engaged, the clasp means 19 and 22, or 19*a* and 22*a*, firmly secures said resonance chambers 5 and 5*a* in place. It should be understood that other clasp means may be employed to secure said chambers 5 and 5*a*.

Tone bars 9 and 9*a* rest within said tone resonance chambers 5 and 5*a*, respectively, on a pair of dowel supports 23, which have pins 24 and 24*a* passing through holes 9*b* in said bars 9 and 9*a*. Preferably, the length of said dowel support 23 is so selected that upon assembly said tone bars 9 and 9*a* are centrally and securely situated within said tone resonance chambers 5 and 5*a*, respectively. To permit relatively free vibration of stricken tone bars 9 and 9*a* rubber grommets 25 are interposed between the pins 24 and 24*a* and the tone bars 9 and 9*a*. The grommets 25 preferably also extend slightly outwards beyond the faces of the tone bars 9 and 9*a* to further cushion the bars 9 and 9*a* from the dowel supports 23 and 23*a* and wedge members 26 and 26*a* affixed to the inside surfaces of said inner side walls 11 and 11*a*. Wedge members 26 and 26*a* have a sufficient thickness to engage said grommets 25 and thereby prevent said tone bars 9 and 9*a* from falling off the pins 24 and 24*a* during transit and handling of the chime assembly.

A decorative cover (not shown) may overlie the door chime assembly 1 to cover the solenoid means 6 and chambers 5 and 5*a* with a more aesthetic front. The decorative cover should include a plurality of holes or slots to transmit the resonating sounds produced therein and alert persons adjacent the place where the chime assembly is installed.

As mentioned in the background and objects section, an advantage of the invention is to reduce the number of component parts necessary to construct a door chime assembly. In the above embodiment as illustrated in FIGS. 1–4, the entire door chime base portion, including rear support 3, resonance chambers 5 and 5*a*, clasps 19 and 19*a*, and living hinges 17, 17*a*, 20 and 20*a*, is made of one piece, eliminating a variety of separate component parts and reducing the amount of handling and assembly required, particularly in constructing or adding the tone resonance chambers 5 and 5*a*. A further benefit of the foregoing construction is that the tone bars 9 and 9*a* are prevented from falling off the pins 24 and 24*a* and thus, do not become loose or misaligned during shipping.

It should be understood that although a pair of resonance chambers 5 and 5*a* are illustrated and described, the invention may utilize a single chamber or more than two chambers. It should also be understood that it is not necessary that all resonance chambers have a tone bar therein. A combination of "empty" chamber and a chamber with a tone bar may thus be employed if it is desired to use the structure of the invention with only a single tone bar.

Although a preferred embodiment of the present invention has been described and illustrated, it will be apparent to those skilled in the art that various modifications may be made without departing from the principles of the invention.

What is claimed is:

1. A door chime assembly comprising:

a one-piece chime base including a rear plate and a plurality of walls formed integral with said plate and defining a resonance chamber, at least one wall of said plurality of walls being pivotally attached to said rear plate by a living hinge;

a tone bar housed within said resonance chamber; and electrically operable striking means mounted on said chime base for striking said tone bar and causing it to vibrate.

2. A door chime assembly as set forth in claim 1, further comprising at least one dowel support within said chamber and attached to a first one of said walls of said resonance chamber for supporting said tone bar.

3. A door chime assembly as set forth in claim 2, further comprising grommet means around said dowel support and engaging said tone bar to allow relatively free vibration of said tone bar.

4. A door chime assembly as set forth in claim 3, wherein said first one of said walls faces a second one of said walls of said resonance chamber and wherein said dowel support extends substantially from said first one of said walls to said second one of said walls whereby said tone bar is prevented from falling off said dowel.

5. A door chime assembly as set forth in claim 1, wherein a wall of said resonance chamber includes at least one opening to allow said striking means to strike said tone bar.

6. A door chime assembly as set forth in claim 1, wherein said chime base is made of plastic.

7. A door chime assembly as set forth in claim 6, wherein said plastic is polypropylene.

8. A door chime assembly as set forth in claim 1, wherein said chime base includes a further plurality of walls defining a further resonance chamber spaced from the first-mentioned resonance chamber, said further resonance chamber having one of its plurality of walls attached to said rear plate by a living hinge and housing a second tone bar, and wherein said striking means is constructed to strike either of said tone bars.

9. A door chime assembly as set forth in claim 1, wherein said hinge is a living hinge.

10. A door chime assembly as set forth in claim 1, wherein another one of said plurality of walls other than said one pivotally attached wall is secured to said rear plate, said pivotally attached wall being pivotable between a first position in which it extends at an angle to said another wall and a second position in which it extends substantially parallel to said another wall, and said assembly further comprises clasp means acting between said one pivotally attached wall and said another wall for maintaining said one pivotally attached wall in said second position.

11. A door chime assembly as set forth in claim 10, wherein said one pivotally attached wall comprises two portions at right angles to each other, one of said portions being pivotally attached to said rear plate, and the other of said portions having an edge which is adjacent said another wall when said one pivotally attached wall is in said second position, and said clasp means comprises straps pivotally attached to one of said other portion and said another wall and projections engageable with said straps extending from the other of said other portion and said another wall.

12. A one-piece base for a door chime assembly comprising:

a rear plate; and a plurality of walls defining a resonance chamber, a first one of said walls being secured to said rear plate and extending substantially perpendicular thereto, a second one of said walls being pivotally attached to said rear plate by a hinge and in spaced relation to said first one of said walls and extending from said rear plate to said first one of said walls, and a pair of spaced third walls secured to said rear plate at an angle to said first one of said walls and extending from said second one of said walls to said first one of said walls to provide an enclosed resonance chamber, said second one of said walls being movable from a first position in which it extends at an angle to said first one of said walls to a second position in which an edge thereof is adjacent to said first one of said walls.

13. A one-piece door chime assembly including the base as set forth in claim 12 further comprising:

a tone bar mounted within said resonance chamber, and electrically operable striking means external to said resonance chamber and mounted on said rear plate for striking said tone bar and causing it to vibrate.

14. A one-piece door chime assembly as set forth in claim 13, further comprising at least one dowel support within said chamber and attached to one of said walls of said resonance chamber for supporting said tone bar.

15. A one-piece door chime assembly as set forth in claim 14, further comprising grommet means around said dowel support and engaging said tone bar to allow relatively free vibration of said tone bar.

16. A one-piece door chime assembly as set forth in claim 15, wherein said second one of said walls faces said first one of said walls and wherein said dowel support extends substantially from said second wall to said first wall whereby said tone bar is prevented from falling off said dowel.

17. A one-piece door chime assembly as set forth in claim 13, wherein a wall of said resonance chamber includes at least one opening to allow said striking means to strike said tone bar.

18. A one-piece base for a door chime assembly as set forth in claim 12, wherein said chime base is made of plastic.

19. A one-piece base for a door chime assembly as set forth in claim 18, wherein said plastic is polypropylene.

20. A one-piece door chime assembly as set forth in claim 13, wherein said chime base includes a further plurality of walls defining a further resonance chamber spaced from the first-mentioned said resonance chamber, said further resonance chamber having a wall thereof attached to said rear plate by a hinge and housing a tone bar, and wherein said striking means strikes either of said tone bars.

21. A one-piece base for a door chime assembly as set forth in claim 12, wherein said hinge is a living hinge.

22. A one-piece base for a door chime assembly as set forth in claim 12, further comprising clasp means acting between said second one of said walls and said first one of said walls for maintaining said second wall in said second position.

23. A one-piece base for a door chime assembly as set forth in claim 22, wherein said second one of said walls comprises two portions at right angles to each other, wherein one of said portions is pivotally attached to said rear plate and an edge of the other of said portions is adjacent said first one of said walls when said second wall is in said second position, and wherein clasp means comprises straps pivotally attached to one of said other portion and said first wall and projections engageable with said straps secured to the other of said other portion and said first wall.

24. A door chime assembly comprising:

a one-piece chime base including a rear plate and a plurality of walls extending integrally from said rear plate, said plurality of walls defining a resonance chamber, and at least one wall of said plurality of walls being pivotally attached to said rear plate by a living hinge;

at least one dowel support extending from one wall of said plurality of walls toward another wall of said plurality of walls and having a free end adjacent said another wall; and a tone bar mounted on said dowel support, said free end of said dowel support being in such proximity relation to said another wall as to prevent said tone bar from separating from said dowel support.

25. A door chime assembly comprising:

a base including a rear plate and a plurality of spaced walls extending from and secured to said rear plate;

at least one dowel support extending from one wall of said plurality of walls toward another wall of said plurality of walls and having a free end adjacent said another wall; and a tone bar mounted on said dowel support, said free end of said dowel support being in a position relative to said another wall such that said tone bar is prevented from separating from said dowel support.

26. A door chime assembly as set forth in claim 25 wherein said tone bar is mounted on said dowel support by a resilient grommet intermediate said tone bar and said dowel support and wherein said free end of said dowel support is at a distance from said another wall less than the thickness of said grommet in the direction in which said dowel support extends toward said another wall.

* * * * *